United States Patent [19]

Ohtake et al.

[11] 4,172,704

[45] Oct. 30, 1979

[54] METHOD FOR DYEING A BUNDLE OF FIBERS SUCH AS A SLIVER OR TOP

[75] Inventors: Sadao Ohtake, Nishinomiya; Shuji Hayashida, Osaka; Hirotsugu Matsunaga, Yokkaichi; Michinobu Kaimori, Suzuka, all of Japan

[73] Assignee: Kanebo Limited, Tokyo, Japan

[21] Appl. No.: 908,054

[22] Filed: May 22, 1978

[30] Foreign Application Priority Data

May 25, 1977 [JP] Japan ..... 52-61548

[51] Int. Cl.[2] ..... D06B 23/00

[52] U.S. Cl. ..... 8/150; 68/3 R; 68/210

[58] Field of Search ..... 8/147, 150, 154, 155, 8/155.1, 155.2; 68/3 R, 13 R, 189, 210; 28/289

[56] References Cited

U.S. PATENT DOCUMENTS

| | | | |
|---|---|---|---|
| 2,779,977 | 2/1957 | Wilkie | 8/155.1 X |
| 3,064,328 | 11/1962 | McClure et al. | 68/13 R X |
| 3,234,627 | 2/1966 | Russo et al. | 28/289 |
| 3,344,622 | 10/1967 | Kronsbein | 68/189 X |

*Primary Examiner*—Philip R. Coe
*Attorney, Agent, or Firm*—Miller & Prestia

[57] ABSTRACT

Disclosed is a method for dyeing a bundle of fibers, such as a sliver, wool top or a synthetic-fiber tow. A bundle of fibers is accumulated into a dyeing can, comprising a main can and an auxiliary can, and, then, the bundle of fibers in the auxiliary can is pressed from above to pack the bundle of fibers in the main can in the compressed condition. Thereafter, the auxiliary can is separated from the main can. Next, a plurality of full packaged main cans are arranged in a predetermined positional relationship which conforms to the layout of the main cans in a dyeing bath and the full packaged main cans are charged into the dyeing bath while maintaining their prepared positional relationship. Then, the dyeing operation is carried out. After completion of the dyeing operation the main cans are taken out from the dyeing bath and are turned over so as to take out the packed bundle of fibers therefrom. To carry out the dyeing method, the dyeing can is provided with a particular construction comprising a main can and an auxiliary can which is capable of being separably assembled to the main can. Therefore, particular devices such as a cans-arrangement station, sliver filling device, pressing device, dismounting station, transfer device, lid separating device and turnover device, etc., which are arranged along an operational line to carry out the above-mentioned method, are utilized.

4 Claims, 28 Drawing Figures

Fig. 10
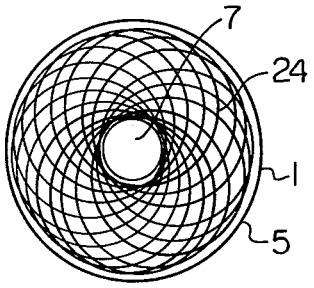
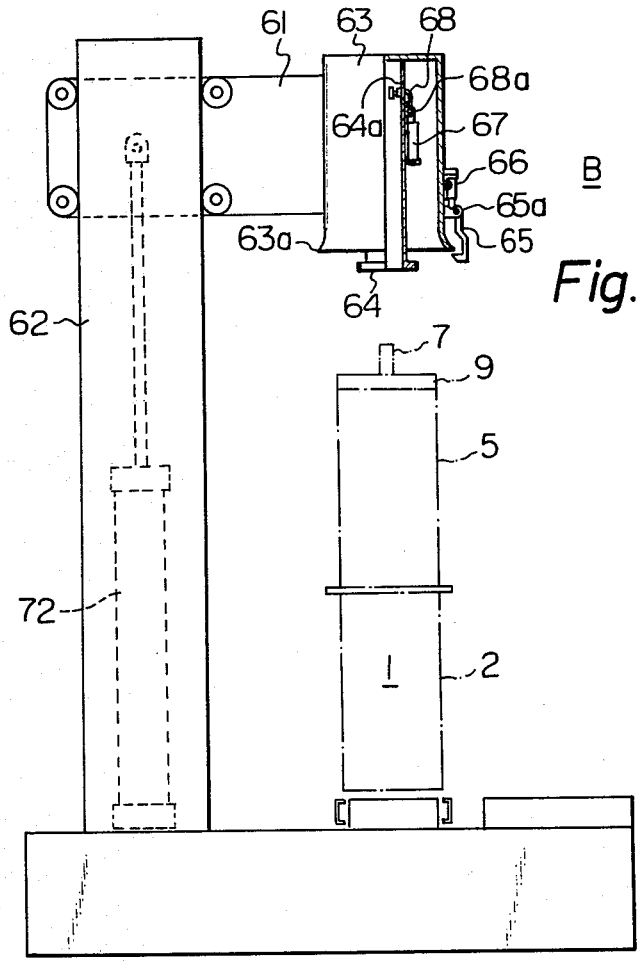
Fig. 11

METHOD FOR DYEING A BUNDLE OF FIBERS SUCH AS A SLIVER OR TOP

BACKGROUND OF THE INVENTION

The present invention relates to a method for dyeing a bundle of fibers, such as a sliver, wool top or a synthetic-fiber tow.

According to the conventional method for dyeing a bundle of fibers, such as disclosed in "The Theory and Practice of Wool Dyeing", chapter 12, written by Mr. C. L. BIRD, and published in 1963, by the Society of Dyers and Colourists, in England, a plurality of balls of cross-wound bundles of fibers formed by a balling machine, each having a weight of 6 to 8 kg, are mounted on a perforated spindle uprightly disposed in a cage for dyeing. Then, these balls are compressed so as to keep them in a desired condition of fiber density. Thereafter the cage is inserted into a dyeing bath and, then, a dyeing operation is carried out by passing streams of a predetermined dyeing solution through the balls according to a customary procedure. After completion of the dyeing operation, the cage is taken out from the dyeing bath and the dyed balls are separated from the spindles, and water contained in these dyed balls is removed therefrom. However, this conventional method is not completely satisfactory with respect to the quality of dyed products and the efficiency of the dyeing operation. More specifically, since the balls of a bundle of fibers to be dyed are formed by cross winding, even if they are compressed and packed in the dyeing cage, the density is not easily made uniform and uneven dyeing is readily caused. Further, since such operations as taking out the dyeing cage from the dyeing bath and dismounting the wound balls from the dyeing cage have to be carried out manually, the overall operational efficiency is very low. Accordingly, development of a method and apparatus free of these drawbacks has been eagerly desired in the art.

BRIEF SUMMARY OF THE INVENTION

The dyeing method according to the present invention is carried out according to the steps of:

(a) filling a bundle of fibers (hereinafter referred to as a sliver) being deposited in the form of a coil into a dyeing can comprising a main can and an auxiliary can separatably mounted thereon;

(b) creating a full packaged dyeing can provided with a main can containing a compressed mass of the bundle of fibers by pushing a total mass of the bundle of fibers accumulated in both the auxiliary can and the main can from above until the total mass of the bundle of fibers initially accumulated in the auxiliary can is pressed into the main can and the auxiliary can is emptied, and then, separating the auxiliary can from the main can;

(c) arranging a plurality of main cans holding sliver in a predetermined positional relationship conforming to the layout of the main cans in a dyeing bath;

(d) mounting the main cans in the dyeing bath while maintaining the above positional relationship and conducting the dyeing operation, and;

(e) taking out the main cans from the dyeing bath after completion of the dyeing operation and turning over the main cans to take out the packed slivers therefrom.

The above-mentioned dyeing method is carried out by means of a dyeing system provided with the following apparatus. That is, in the dyeing system of the present invention a plurality of sliver-filling devices for carrying out the above-mentioned step (a), a pressing device for carrying out the above-mentioned step (b), a device for measuring the weight of each main can holding a sliver in full condition, a plurality of storage conveyers, an arrangement station, a plurality of dyeing baths and a dismounting station, are mutually connected with one another through conveyers, transporting trucks and an overhead crane.

BRIEF EXPLANATION OF THE DRAWINGS

FIG. 10 is a plan view indicating the sliver coils accummulated in a dyeing can according to the present invention;

FIG. 11 is a schematic side view of a pressing device according to the present invention;

DETAILED DESCRIPTION OF THE PREFERRED EMBODIMENTS OF THE PRESENT INVENTION

This invention will now be described in detail by reference to embodiments illustrated in the accompanying drawings.

Figure 1:
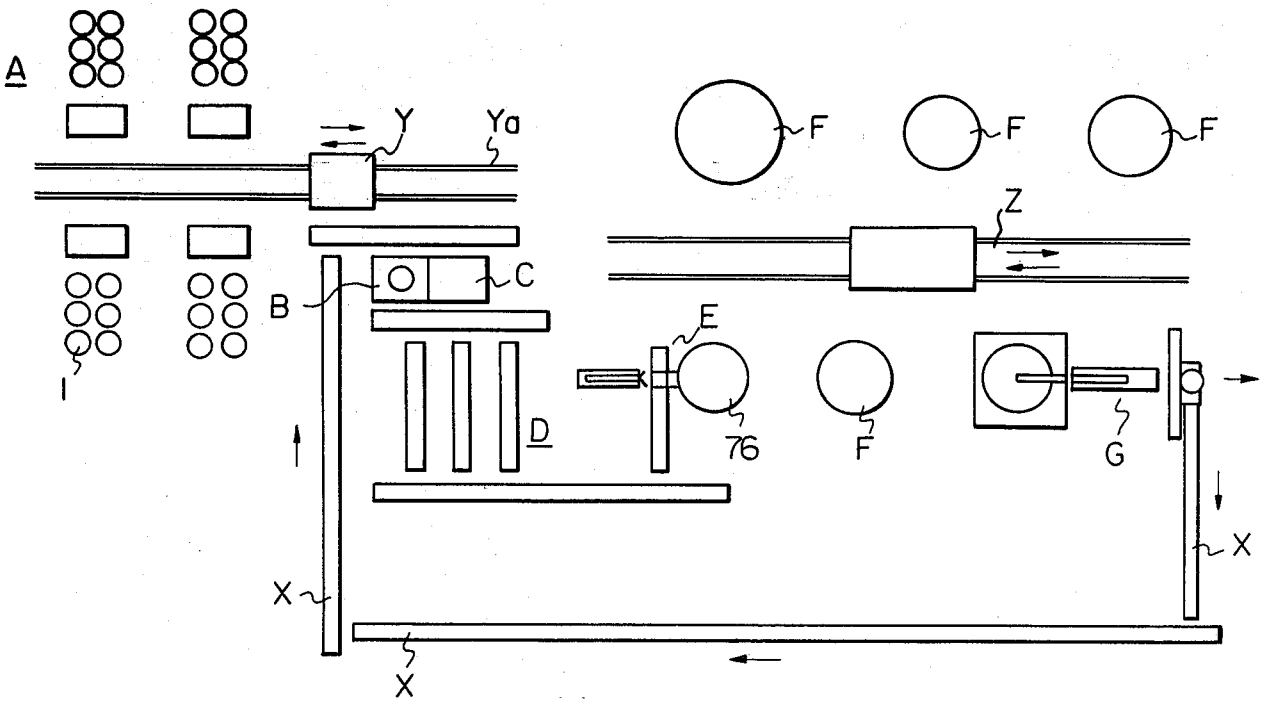
FIG. 1 is a schematic plan view of the sliver dyeing system according to the present invention.

The dyeing method of the invention is practised by using a dyeing system including devices arranged as shown in FIG. 1. More specifically, the dyeing system comprises a plurality of sliver filling devices A, a pressing device B, a weighing device C, a plurality of storage conveyers D, a cans-arrangement station E, a plurality of dyeing baths F and a dismounting station G, and; these devices are mutually connected to one another through conveyers X, transporting trucks Y and an over head crane device Z running on the ceiling.

For the sake of a better understanding the present invention, respective devices constituting the dyeing system of this invention will now be described in detail by reference to the respective steps of the dyeing method.

Step (a)

(a-1) Dyeing Can

Figure 2:
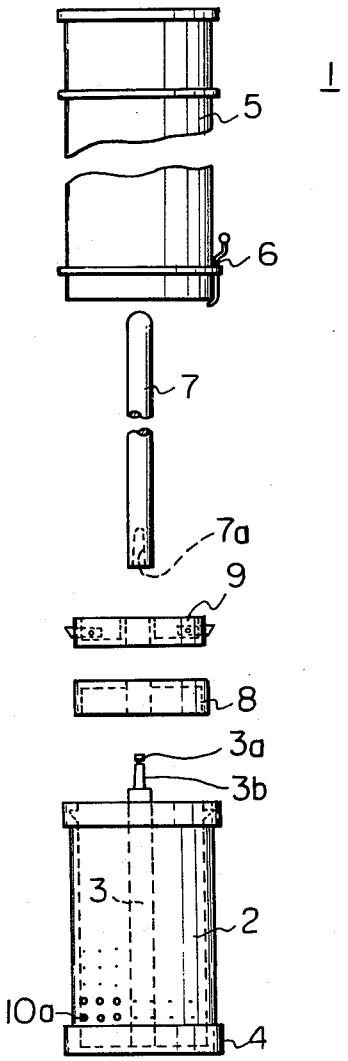
FIG. 2 is a front view of a dyeing can, with the elements thereof separated, utilized for the present invention.
Figure 3A:
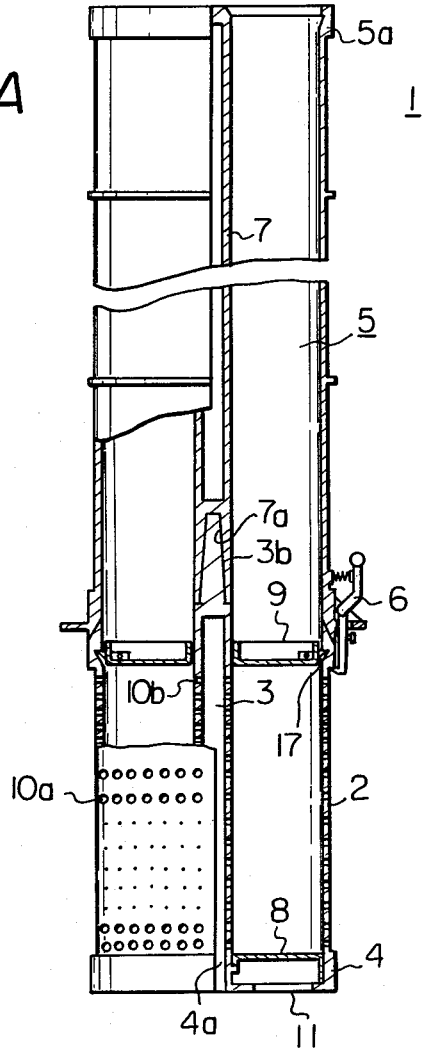
FIG. 3A is a partially sectional front view of the dyeing can shown in FIG. 2, in assembled condition.
Figure 3B:
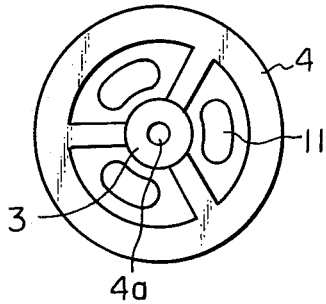
FIG. 3B is a bottom view of the dyeing can shown in FIG. 3A.

A sliver to be treated is first filled in a dyeing can. As shown in FIGS. 2 and 3A, the dyeing can 1 utilized for this invention comprises: a framework including a cylindrical can body (hereinafter referred to as a main can) 2 and a hollow spindle 3 projected from a center of a fixed bottom plate 4 thereof in upright condition; a cylindrical auxiliary can 5 having an identical internal diameter to that of the main can 2 and being capable of being separably mounted on an upper peripheral edge of said main can 2 by means of a fixing device 6, and; an auxiliary spindle 7 which can be separably joined to the upper end of the hollow spindle 3, a movable bottom plate 8 and a movable upper lid 9, which plate and lid are inserted into the main can 2 and the auxiliary can 5, respectively, in such conditions that the bottom plate 8 and upper lid 9 are capable of moving in a vertical direction along the hollow spindle 3 and the auxiliary spindle 7. The cylindrical walls of the main can 2 and the hollow spindle 3 are provided with a number of apertures 10*a* and 10*b* (FIG. 3A), respectively, which allow free passing of dyeing liquid therethrough. A central aperture 4*a* (FIG. 3A) for passing the dyeing liquid is formed through the fixed bottom plate 4 so that the central aperture 4*a* communicates with the hollow portion of the hollow spindle 3. The bottom plate 4 is, as illustrated in FIG. 3B, provided with a plurality of apertures 11 which are equidistantly spaced around the central aperture 4*a*, and vertically movable levers and push out rods, as described later, pass through the respective apertures 11.

In the assembled state, as illustrated in FIG. 3A this dyeing can 1 is integrated by the fixing device 6 and has a sufficient resistance to resist deformation by an external force which is applied thereto during transportation.

This fixing device 6 will now be described in detail.

Figure 4A:
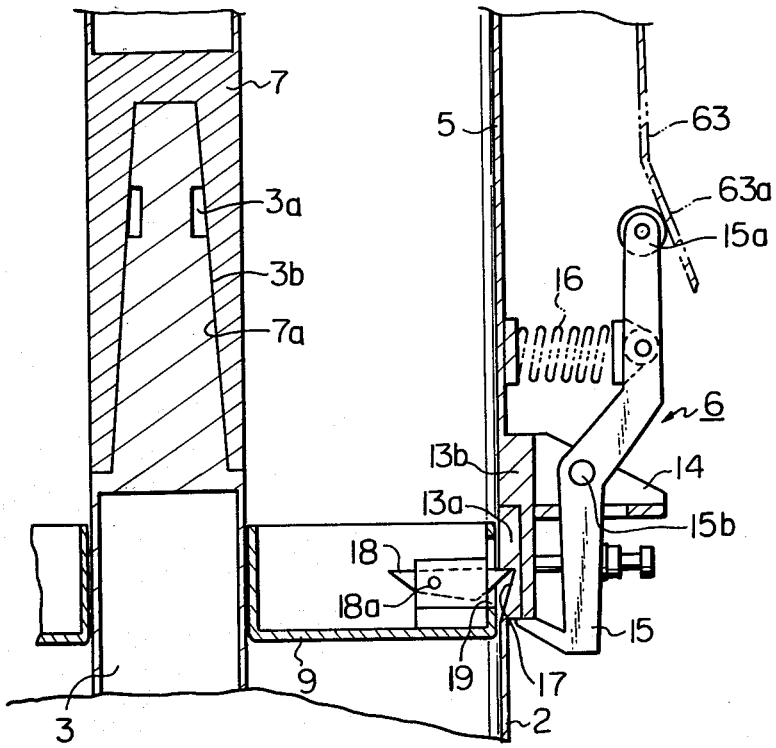
FIG. 4A is a side view of a fixing device for assembling a main can with an auxiliary can shown in FIGS. 3A and 3B.
Figure 4B:
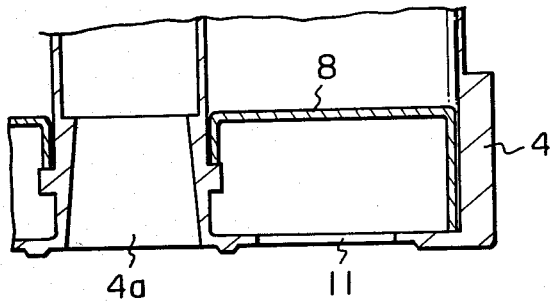
FIG. 4B is a partially sectional side view of the main can according to the present invention.

An embodiment of the fixing device 6 is illustrated in FIG. 4A. Referring to FIG. 4A, both the cans 2 and 5 are tentatively set by male and female fitting portions 13*a* and 13*b* formed around the peripheries of the upper edge of the main can 2 and the lower edge of the auxiliary can 5, respectively. Both of the cans 2 and 5 are pivotally supported by flange-shaped brackets 14 formed at positions dividing the outer periphery of the auxiliary can 5 into several identical portions, for example, three identical portions. Furthermore, both of the cans 2 and 5 are rigidly secured by a J-shaped stopper 15 pivoted via pin 15*b* on the bracket 14 and urged by a compression spring 16 to press both the male and female fitting portions 13*a* and 13*b* from the lower portions and the side portions thereof. The urging action of the stopper 15 can be released if one end 15*a* of the stopper 15 is pressed down due to the downward movement of a cylinder 63 with an outwardly flared skirt portion 63*a* as described later, and then, both the cans 2 and 5 are separated from each other.

Figure 5:
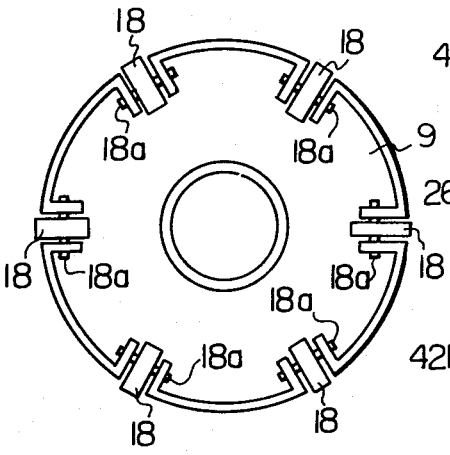
FIG. 5 is a plan view of an upper lid utilized for the dyeing can according to the present invention.

A ring shaped groove 17 having a triangular cross section is formed on the inner periphery of the upper edge of the can body 2 so that the groove 17 can be engaged with movable claws 18 pivoted via pins 18*a* at positions dividing the peripheral edge of the moving upper lid 9 into six identical portions (see FIG. 5). In the engaged condition, the downward movement of the moving upper lid 9 is not disturbed but the upward movement beyond the position of the groove 17 is prevented.

More specifically, referring to FIG. 4A again, since each movable claw 18 is pivoted in such a positional relationship to the movable upper lid 9 that in the horizontal position, the top end of the claw 18 is slightly bulged out beyond the outer periphery of the moving upper lid 9, when the movable claw 18 conforms to the groove 17, it falls into engagement therewith, and; since further displacement of the claw 18 is prevented by the stopper 19 disposed below, the upward movement of the movable upper lid 9 is prevented. On the descending movement, the top end of the movable claw 18 slides along the groove 17, which is tapered so that the depth is gradually decreased toward the lower portion, and the claw 18 turns counterclockwisely. Then, the top end of the movable claw 18 retreats into the inside of the movable upper lid 9 and, then, the claw 18 separates from the groove 17.

An aperture 7*a* having a concave-conical shape, is formed in the base of the auxiliary spindle 7, and this perforated base portion is fitted on the top portion 3*b* of the hollow spindle 3, which has a frusto conical shape and the auxiliary spindle 7 is set and held.

(a-2) Sliver Filling Device

The sliver filling device 20 for filling the dyeing can 1 with a sliver will now be described.

Figure 6:
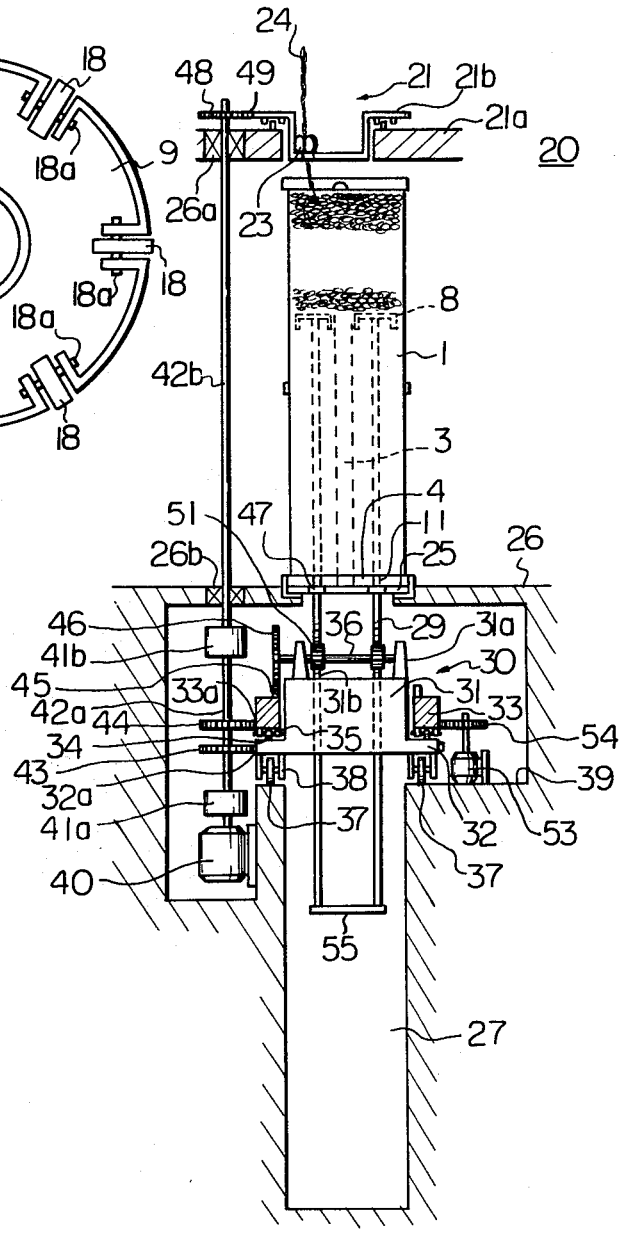
FIG. 6 is a schematic side view of the sliver filling device according to the present invention.

Referring to FIG. 6, which is a sectional side view showing the sliver filling device 20 according to the present invention, a coiler head 21 is disposed at the bottom end of a sliver-manufacturing machine such as a drawing frame, a gill box (not shown) or the like. The coiler head 21 comprises a disc 21*b* which can be rotated around a vertical axis by a driving power transmitted from a main motor 40 described hereinafter. Feed rollers 23 are rotatably located at one corner of the coiler head 21. Sliver 24 is delivered from the nip line of the feed rollers 23 in such a condition that the nip line is moved along a horizontal circular trace created by the rotation of a coiler head 21 and, consequently, the sliver 24 is downwardly fed while generating coils. A bottom plate 25 is capable of being rotated around the axis thereof, as described later. The axis is slightly deviated from the center of the coiler head 21. The bottom plate 25 is disposed on the floor 26 right below the coiler head 21, so that the bottom plate 25 is capable of revolving about the center of the coiler head 21. This bottom plate 25 is arranged in such a condition that it can carry thereon the dyeing can 1, for the filling of the sliver 24 therein.

A pit 27 is formed on the floor 26 below the bottom plate 25. Three vertically movable levers 29 projecting upwardly through the bottom plate 25, which are arranged in parallel condition, are positioned in the interior of the pit 27. Furthermore, a device 30 for driving the levers 29 is disposed in the pit 27, so as to move the levers 29 in the vertical direction and revolve them around the central axis of the bottom plate 25.

Figure 7:
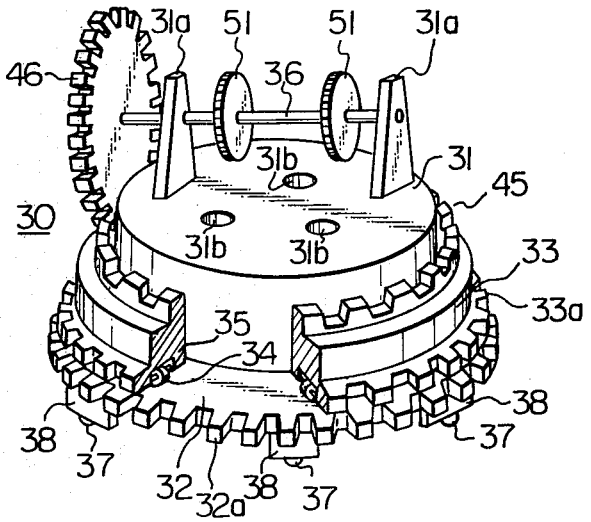
FIG. 7 is a schematic perspective view of a gear assembly utilized for the sliver filling device shown in FIG. 6.

The top end of each lever 29 is intruded into the dyeing can 1 placed on the bottom plate 25 to support the movable bottom plate 8 thereof from below. By the vertical movement of the levers 29 the bottom plate 8 can be vertically moved in the can 1. Further, since the bottom plate 25 is rotatably disposed on the floor 26, as described hereinbefore, it is allowed to turn the bottom plate 25 according to the revolution of the levers 29 around the central axis of the bottom plate 25. As shown in FIGS. 6 and 7, the driving device 30 comprises a pedestal 31, provided with a flange portion 32 projected outward from the bottom portion thereof, and a ring shaped body 33 mounted on the flange portion 32 by way of a plurality of wheels 34. The wheels 34 are rotatably supported by the respective brackets 35 secured to the bottom surface of the ring shaped body 33, in such a condition that the ring shaped body 33 and the pedestal 31 are coaxially disposed. The pedestal 31 is provided with a pair of brackets 31*a* projected upright therefrom and a horizontal shaft 36 is rotatably supported by the brackets 31*a*. The pedestal 31 is further provided with a plurality of wheels 37, which are rotatably supported by the respective brackets 38 secured to the bottom surface of the pedestal 31, and the wheels 37 ride on a part of floor 39 formed in the pit 27. As shown in FIG. 6, the levers 29 also pass through respective apertures 31*b* formed in the pedestal 31. A main motor 40, disposed in the pit 27, rotates a vertical shaft 42*a* by way of a clutch 41*a*. Pinions 43 and 44 are secured on the shaft 42*a* in such conditions that they engage with wheel teeth 32*a*, 33*a* formed on the outer surface of the flange 32 and the ring shaped body 33, respectively. The ring shaped body 33 is provided with teeth 45 formed on a cylindrical body projected upwardly from the upper surface of the ring shaped body 33 and the teeth 45 engaged with a pinion 46 secured to an end portion of the horizontal shaft 36. A vertical shaft 42*b* is rotatably supported by bearings 26*a* and 26*b* which are mounted on a frame 21*a* of the coiler head 21 and the floor 26, respectively, at a position along the upward axial extension of the shaft 42*a*. The shaft 42*b* is capable of being connected to the shaft 42*a* by means of a clutch 41*b*. A pinion 48 is secured to the top end of the shaft 42*b* and engages with a wheel teeth 49 formed at the outside portion of the coiler head 21.

Figure 8:
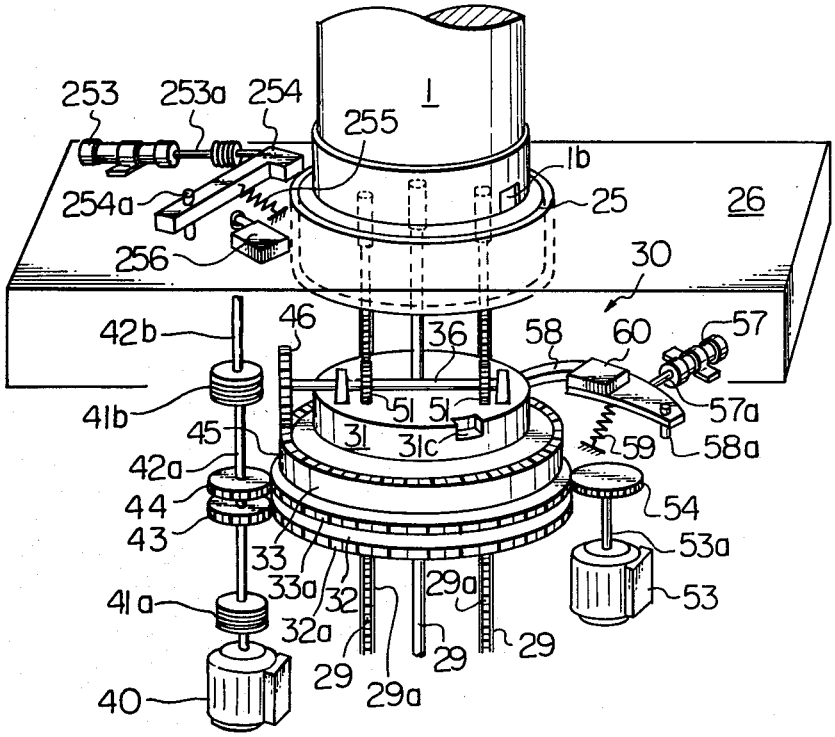
FIG. 8 is a schematic perspective view of a can-position setting device utilized for the sliver filling device shown in FIG. 6.

In the above-mentioned sliver filling device 20, a mechanism for positioning a dyeing can 1 at a predetermined position on the bottom plate 25 is provided. Referring to FIG. 8, a pneumatic cylinder 253 provided with a piston rod 253*a* is mounted on the floor 26 at a position close to the bottom plate 25. A reverse L-shaped stopper 254 is turnably mounted via a pin 254*a* on the floor 26 at a position between the piston rod 253*a* and the bottom plate 25. A compression spring 255, one end of which is secured to the floor 26, always urges the stopper 254 toward the piston rod 253*a*. Each dyeing can 1 is provided with a plurality of recesses 1*b* formed at the outside surface of the bottom edge thereof in such a condition that a free end of the stopper 254 is capable of engaging with one of the recesses 1*b* when the piston rod 253*a* pushes the stopper 254 while the dyeing can 1 is rotated together with the bottom plate 25. A limit switch 256 is also mounted on the floor 26 in a position where the stopper 254 is capable of pushing a feeler of the limit switch 256 when the free end of the stopper 254 engages with one of the recesses 1*b* of the dyeing can 1. On the other hand, another pneumatic cylinder 57 provided with a piston rod 57*a* is mounted on an inside surface of the pit 27 (FIG. 6) at a position close to the pedestal 31. A stopper 58 is turnably mounted via pin 58*a* on the inside surface of the pit 27 (FIG. 6) at a position between the piston rod 57*a* and the pedestal 31, in such a condition that the piston rod 57*a* is capable of pushing the stopper 58 when the pneumatic cylinder 57 is actuated. A compression spring 59, one end of which is secured to the inside surface of the pit 27 (FIG. 6), always urges the stopper 58 toward the piston rod 57*a*. The pedestal 31 is provided with a plurality of recesses 31*c* formed at the peripheral surface portion thereof in such a condition that a free end of the stopper 58 is capable of engaging with one of the recesses 31*c* when the pneumatic cylinder 57 is actuated while the pedestal 31 is rotating. A limit switch 60 having a function similar to that of the limit switch 256 is disposed at a position between the pedestal 31 and the stopper 58.

In the above-mentioned arrangement, the rotation of the main motor 40 is transmitted to the pedestal 31 and ring shaped body 33 through the pinions 43 and 44 to rotate the pedestal 31 and ring shaped body 33. Since the number of teeth on the pinion 43 is slightly smaller than the number of teeth on the pinion 44, the ring shaped body 33 and pedestal 31 are rotated in the same direction but with a slight relative divergence therebetween. As a result, the pinion 46 attached to the rotary horizontal shaft 36 is gradually rotated, and also, the rotary horizontal shaft 36 is rotated with the rotation of the pinion 46. A pair of pinions 51 are secured to the rotary horizontal shaft 36 and are engaged with rack teeth 29*a* formed along the entire length of two of vertically movable levers 29. The bottom ends of the three levers 29 are fixed to a disc plate 55 (FIG. 6). Accordingly, the levers 29 are moved in the vertical direction by the pinions 51. An auxiliary motor 53 is disposed independently from the main motor 40 and a pinion 54 secured to the shaft 53*a* of the motor 53 is engaged with wheel teeth 33*a* of the ring shaped body 33. When this auxiliary motor 53 is operated in the state where the clutches 41*a* and 41*b* of the vertical shaft 42*a* are disconnected from the main motor 40 and coiler head 21 (FIG. 6), only the ring shaped body 33 is rotated while the pedestal 31 is kept stationary, and the relative moving speed between them is increased to rotate the rotary horizontal shaft 36 at a high speed. As a result, high-speed vertical movement is made possible in the vertically movable levers 29.

The operation of filling a sliver into the dyeing can 1 by using the above-mentioned filling device 20 will now be described with reference to FIG. 8.

Figure 9:
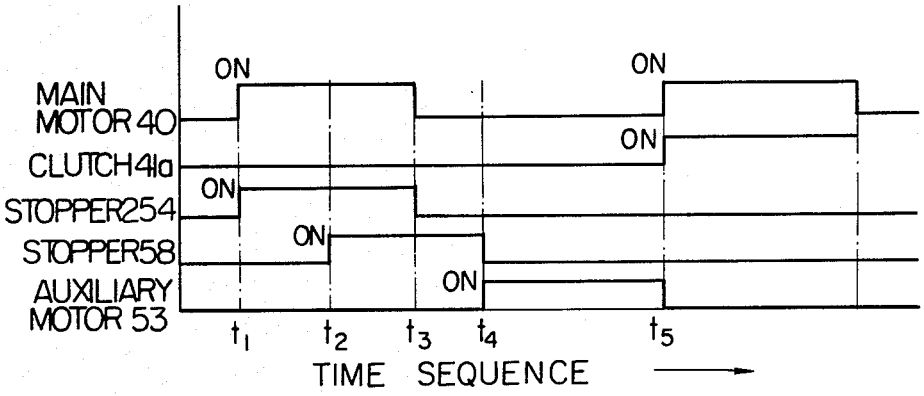
FIG. 9 is a time chart representing the motion of the elements of the can-position setting device shown in FIG. 8.

After the doffing of the previous full packaged can, the levers 29 are made ready for the next doffing operation at a lowermost position below the top face of the bottom plate 25. In this state, an empty dyeing can 1 is vertically mounted on the bottom plate 25. The upper clutch 41*b* is then disconnected and the driving of the main motor 40 is started. The pneumatic cylinder 253 is simultaneously actuated to press the free end of the stopper 254 toward the peripheral face of the bottom edge portion of the can 1. As a result, although the can 1 is rotated with the bottom plate 25, when the free end of the stopper 254 falls into engagement with one of recesses 1*b* formed at the peripheral face of the bottom edge portion of the can 1, the rotation of the can 1 is inhibited and the can 1 is stopped. By this engagement of the stopper 254 with the recess 1*b*, a limit switch 256 is turned on to actuate the pneumatic cylinder 57 to press the stopper 58 toward the peripheral face of the pedestal 31. When the free end of the stopper 58 falls into engagement with one of the recesses 31*c* formed on the peripheral face of the pedestal 31, the limit switch 60 is turned on to cut off the connection of the main motor 40 to the power source and stop the rotation of the pedestal 31. By the foregoing preliminary operation, in FIG. 6, the position of the through hole 11 of the fixed bottom plate 4, of the can 1, is made to conform precisely to the moving passage or apertures 47 for the levers 29 formed on the bottom plate 25. After the lapse of a certain amount of time from the above-mentioned actuation, the limit switches 256 and 60 illustrated in FIG. 8 are caused by the action of the respective timers (not shown) to return the pneumatic cylinders 253 and 57 to their stand-by positions. In this condition, both the limit switches 256, 60 are set in their stand-by condition, and simultaneously, the lower clutch 41*a* is disconnected and the auxiliary motor 53 is actuated to raise the levers 29 up to the uppermost position, while supporting the movable bottom plate 8 from below through the fixed bottom plate 4 of the can 1. The operational sequence of the foregoing procedures is illustrated in FIG. 9.

When the auxiliary motor 53 is thus driven to raise the levers 29 at a high speed, the bottom plate 8 is supported in the upper portion of the can 1 as illustrated by broken lines in FIG. 6. In this condition, if the main motor 40 is driven and the clutches 41*a*, 41*b* are connected thereto, by the action of the above-mentioned driving device 30, the pedestal 31 is rotated, and accordingly, also the levers 29 supported thereon are revolved with the axis of the pedestal 31 as the center, and further, the bottom plate 25 and the can 1 begin to rotate. Simultaneously, also the coiler head 21 and the feed rollers 23 mounted thereon are rotated, and the sliver 24 is fed into the can 1 while generating coils. The levers 29 are gradually brought down while being rotated, and the bottom plate 8 is thus brought down at such a predetermined speed that the density of accumulated sliver is maintained at a predetermined level in the can 1. When the bottom plate 8 is brought down to the lowermost position, a full can 1 containing therein a predetermined amount of the sliver 24 is obtained. In the chart shown in FIG. 9, the condition where the stopper 254 or 58 engages with the respective recess 1*b* or 31*c* is represented by "ON." In the time sequence, "$t_1$" represents the condition where the dyeing can 1 is positioned on the bottom plate 25 (FIG. 8), "$t_2$" and "$t_3$" represent the respective conditions where the limit switches 256, 60 (FIG. 8) are actuated, respectively, the time interval between $t_3$ and $t_4$ is adjusted to a predetermined time period by means of which is utilized for actuating the auxiliary motor 53 (FIG. 8), and "$t_5$" represents the time when the normal operation for filling the sliver into the can 1 (FIG. 8) is started.

In order to make the sliver density in the can 1 uniform, it is preferred that the sliver 24 be deposited so that it generates circles inscribed in the outer circumference of the auxiliary spindle 7 and the hollow spindle 3 and circumscribed in the inner circumference of the can 1 as shown in FIG. 10. When the can 1 is thus filled with the sliver 24, the movable upper lid 9 (FIG. 3A) formed separably is inserted in the upper portion of the auxiliary can 5 (FIG. 3A). A groove 5*a* (FIG. 3A), having the same configuration as that of the groove 17 (FIG. 4A) on the inner periphery of the upper edge of the main can 2, is formed on the inner periphery of the upper edge of the auxiliary can 5. The movable upper lid 9 (FIG. 3A), receiving an upward force owing to the expansion force of the packed sliver 24 (FIG. 6), causes the movable claws 18 (FIG. 4A) to fit in the groove 5*a* (FIG. 3A), whereby the can 1 is covered by the lid 9 (FIG. 3A).

It is preferred that the apparent density of the sliver in the so obtained full can 1 be in the range of from 0.1 to 0.3 g/cm$^3$.

Step (b)

(b-1) Pressing Device

Referring to FIG. 1, the full cans produced in the above-mentioned manner by a plurality of the above-mentioned sliver filling devices A are loaded on a transporting truck Y, running on rails $Y_a$ laid out on the floor, and transported to the pressing device B. This pressing device B has a structure as shown in FIG. 11. More specifically, the pressing device B comprises a mechanism for vertically displacing a press head 61 which is disposed in a movable condition along a vertical frame 62 by means of a hydraulic cylinder 72.

Figure 12:
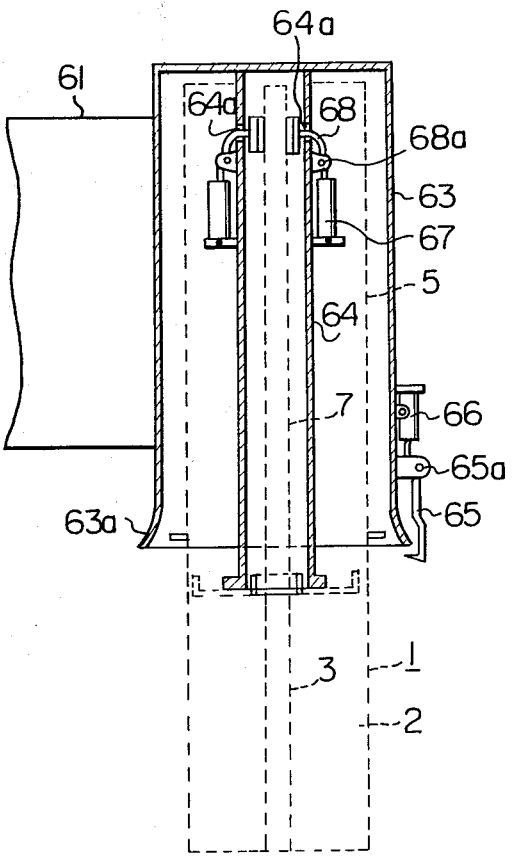
FIG. 12 is a schematic side view, partly in section, of the press head utilized for the pressing device shown in FIG. 11.

As shown in FIGS. 11 and 12, the press head 61 comprises an outside cylinder 63, having such an inner diameter that it is capable of covering the outer periphery of the can 1 with a sufficient margin, and an inside cylinder 64, having an outer diameter smaller than the inner diameter of the can 1, which is capable of covering the outer periphery of the auxiliary spindle 7 with a sufficient margin. The outside cylinder 63 is provided with a downwardly expanding skirt portion 63*a*. These cylinders 63 and 64 are concentrically integrated with each other in the top portions thereof. The depth of each cylinder corresponds to the height of the auxiliary can 5.

Auxiliary can chucks 65, to be operated around a pin 65*a* by pneumatic cylinders 66, are mounted on the outer periphery of the outside cylinder 63 at respective positions dividing the outer cylinder 63 into three symmetrical portions in the circumferential direction. Auxiliary spindle chucks 68, to be operated around a pin 68*a* by pneumatic cylinders 67, are mounted on the outer periphery of the inside cylinder 64 at symmetrical positions in the circumferential direction. The top ends of the auxiliary spindle chucks 68 are capable of intruding into the interior of the inside cylinder 64 through apertures 64*a* formed at parts thereof, so that, as described hereinafter, the peripheral surface of the auxiliary spindle 7 inserted into the inside cylinder 64 can be gripped by them.

After the full can 1 is mounted on a position right below the press head 61 as illustrated in FIG. 11, the head 61 is brought down along the vertical frame 62 by the action of the hydraulic cylinder 72 disposed within the frame 62, while the inside cylinder 64 is displaced downward together with the upper lid 9 so that the mass of sliver accummulated in the can 1 is forced to compress. That is, the bottom end of the inside cylinder 64 pushes the upper lid 9 downward, while the auxiliary spindle 7 is inserted into the inside space of the inside cylinder 64. On the other hand, the outside cylinder 63 is simultaneously displaced downward when the inside cylinder 64 is displaced downward, so that the can 1 is also inserted into the inside space of the outside cylinder 63. When the outside cylinder 63 is brought down to the position of the fixing device 6, described above with reference to FIG. 4A, the skirt portion 63*a* thereof gradually applies a pressing force to one end 15*a* of the stopper 15, as described hereinbefore, to release the locking by the fixing device 6. Simultaneously, referring to FIG. 12 again the pneumatic cylinder 66 attached to the auxiliary can chuck 65 is actuated and the lower end of the chuck 65 is intruded below the lower face of the flange 14 (FIG. 4A) of the can 1 to grip the can 1.

The upper lid 9 (FIG. 4A) is brought down by the inside cylinder 64 (FIG. 12) while pressing the mass of sliver contained in the can 1. Furthermore, while the above-mentioned auxiliary can chuck 65 (FIG. 12) is operated, the motion of the upper lid 9 (FIG. 4A) is stopped in the state where the six movable claws 18 mounted on the outer periphery of the upper lid 9 are engaged with the groove 17 formed on the inner fixed wall of the upper portion of the main can 2 as shown in FIG. 4A.

Simultaneously with the above-mentioned operations, in FIG. 12, the pneumatic cylinders 67, mounted on the auxiliary spindle chucks 68, are operated so that their top ends grip the peripheral face of the upper portion of the auxiliary spindle 7 from both the sides. Then, the press head 61 starts the lifting-up motion thereof, and with this motion of the press head 61, the auxiliary can 5 and auxiliary spindle 7, which are gripped and supported by the auxiliary can chucks 65 and auxiliary spindle chucks 68, respectively, are caused to displace upward together with the press head 61 and are separated from the main can 2.

The sliver is forced into and held in the main can 2 by the upper lid 9, and the apparent density thereof is increased 2 to 3 times the original density at the time just before the step (b) is applied and the density irregularity is reduced or eliminated. The inventors of the present invention think the reason for this is as follows: When the sliver is filled in the dyeing can composed of the main can and the auxiliary can, the filled sliver has an irregular density. However, the sliver is not prevented from movement when it receives a force acting thereon, because it is loose in the dyeing can. Therefore, when the force is applied to the sliver in the dyeing can composed of the main can and the auxiliary can, and then, the sliver is compressed into the main can, the density irregularity can be reduced or eliminated, since the sliver can be condensed in the portion of the can where the density is low.

Step (c)

(c-1) Cans-arrangement Station

After the quantity of the packed sliver in the main cans 1 has been measured by the weighing device C (see FIG. 1), full packaged main cans 1 are stored in a storage conveyer D in accordance with the production schedule with respect to types of products and treating machines.

The operation of the subsequent cans-arrangement station will now be described in detail. Prior to charging in the dyeing bath F, full packaged main cans 2 are set on a turn table 76 in the same positional relationship as that of the arrangement in the dyeing bath F. The object of this operation is to allow the automatic charging of the cans into the dyeing bath in one step. The operation is accomplished by the following mechanism.

Figure 13:
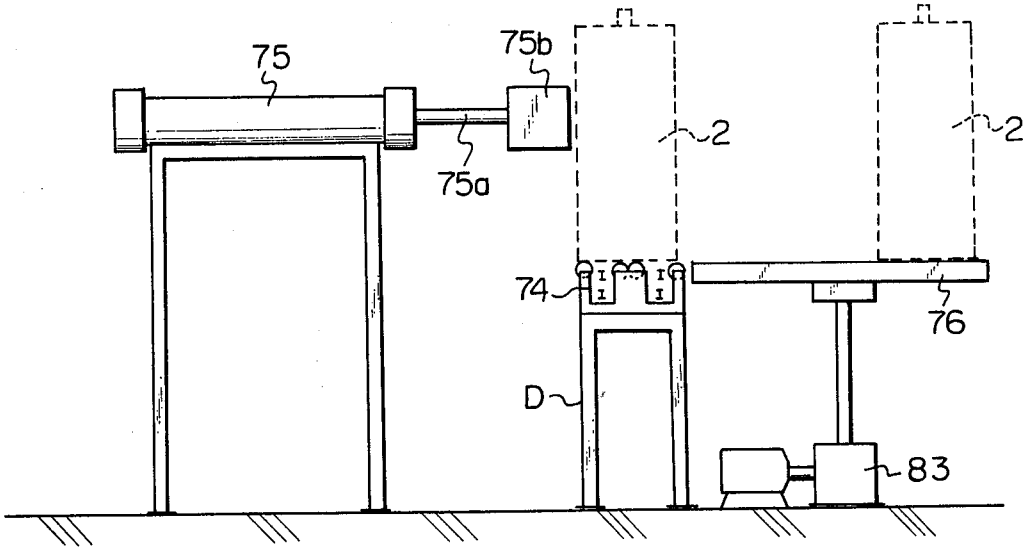
FIG. 13 is a schematic side view of a cans-arrangement station according to the present invention.
Figure 14A:
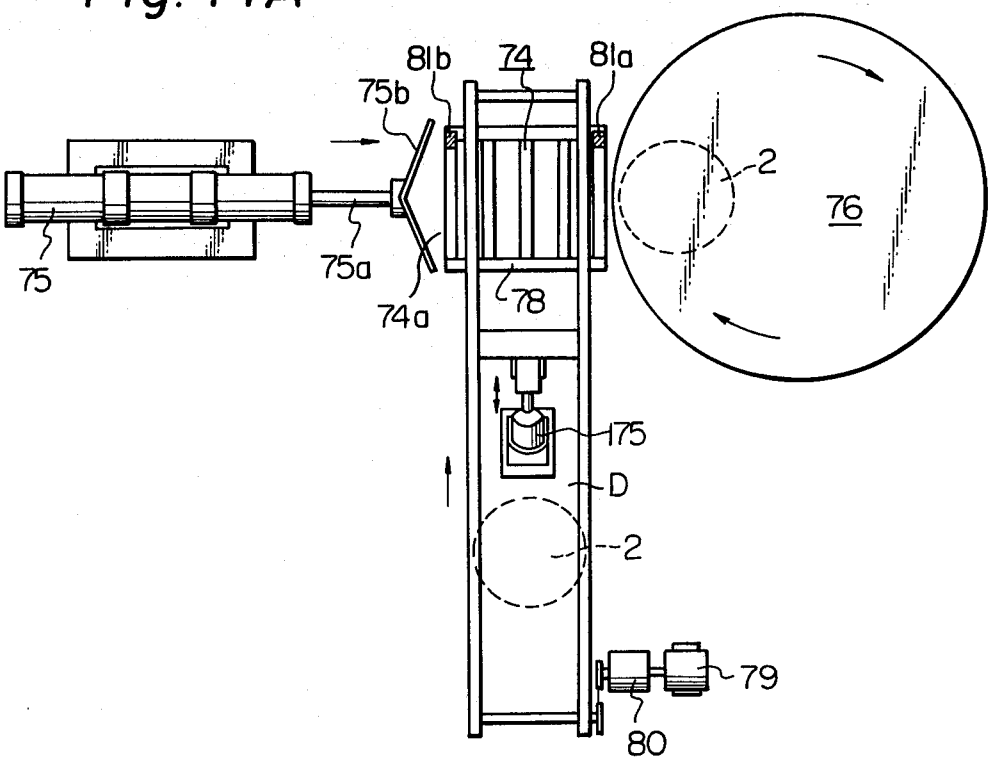
FIG. 14A is a schematic plan view of the cans-arrangement station shown in FIG. 13.
Figure 14B:
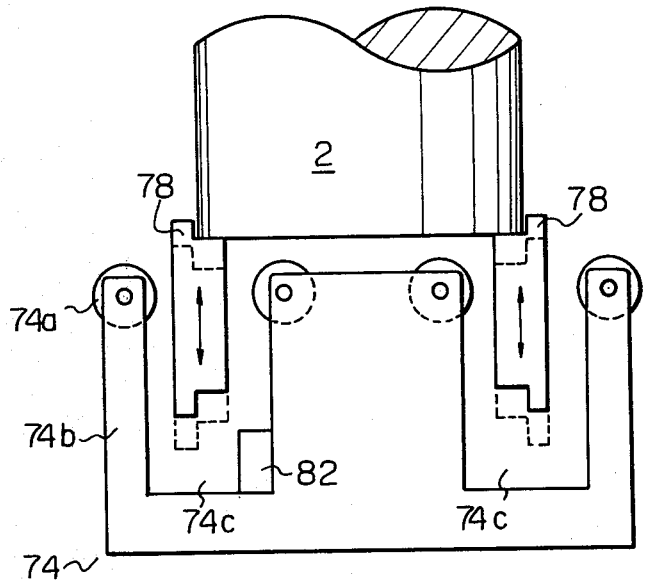
FIG. 14B is a schematic side view of a front portion of a storage conveyer utilized for the cans-arrangement station shown in FIG. 14A.

The cans-arrangement station E has a structure as shown in FIGS. 13, 14A and 14B. In FIG. 14A, the front portion of the storage conveyer D is overlapped on a roller conveyer 74 traversing the storage conveyer D at a right angle thereto. The storage conveyer D is designed so that the top face thereof is located selectively at a position slightly lower or higher than the level of the top face of the roller conveyer 74 by means of a lifter 175.

As shown in FIG. 14B, the roller conveyer 74 comprises a plurality of rollers 74*a* rotatably supported by a frame 74*b* in parallel condition each other. The frame 74*b* is provided with a pair of deep recesses 74*c*. The front portion 78 of the storage conveyer D is inserted into the recesses 74*c* in such a condition that the front portions 78 are capable of moving upward or downward. Consequently, the above-mentioned change of the position of the front portions 78 can be attained. The storage conveyer D is provided with a driving mechanism 79 and a control device 80 for selectively stopping the motion of the driving mechanism 79 as illustrated in FIG. 14A. For example, this control device 80 comprises: a photoelectric device for detecting the arrival of a main can 2 at a predetermined position at the front portion 78 of the conveyer D, such as a light ejector 81*a* and a photocell 81*b*, and; a magnetic clutch (not shown) which is capable of connecting or disconnecting the power transmission between the driving mechanism 79 and the conveyer D, in response to a signal issued from the photocell 81*b*. That is, when a main can 2 arrives at the predetermined position on the front portion 78 of the conveyer D and shuts out a light beam from the light ejector 81*a*, the photocell 81*b* issues a signal to actuate the magnetic clutch (not shown) so as to disconnect the power transmission from the driving mechanism 79 to the conveyer D. The signal issued from the photocell 81*b* is simultaneously transmitted to the lifter 175 so as to displace the front portion 78 downward. In FIG. 14B, a limit switch 82 is mounted on the frame 74*b* of the roller conveyer 74 at a position in the recess 74*c* where it can detect the lowermost position of the front portion 78. When the limit switch 82 detects the descent of the front portion 78 of the conveyer D, the limit switch 82 issues a signal to actuate a pneumatic cylinder 75 (see FIGS. 13 and 14A) which is utilized for pushing the can 2 positioned on the roller conveyer 74 to a turn table 76 disposed at a position at opposite side of the pneumatic cylinder 75 with regard to the roller conveyer 74. The receiving surface of the turn table 76 is positioned at the same level as the roller conveyer 74. The pneumatic cylinder 75 is provided with a plunger 75*a* and a pushing head 75*b* secured to a top end of the plunger 75*a*. The stroke of the plunger 75*a* is designed so as to create a perfect motion to displace a can 2 from the roller conveyer 74 to the turn table 76. A timer (not shown) is utilized so as to actuate a turning mechanism 83 (FIG. 13) after a predetermined time from the issuance of the signal from the limit switch 82 (FIG. 14B). A clutch system, or ratchet driving system (not shown), is utilized for turning the turn table 76 illustrated in FIG. 13 a predetermined angle about the center of the turn table 76. Thus, one cycle of the operations in the arrangement station E is completed.

After completion of the above-mentioned one cycle motion for carrying a full packaged main can 2 by the conveyer D, transferring the main can 2 from the conveyer D to the roller conveyer 74, displacing the main can 2 from the roller conveyer 74 to the turn table 76 and turning the turn table for the predetermined angle about the center of the turn table 76, in FIG. 14A, the power transmission from the driving mechanism 79 to the conveyer D is connected again by actuating the control device 80 by means of another timer (not shown) which is actuated by the above-mentioned signal issued from the limit switch 82 (FIG. 14B). Then, the next cycle motion is started.

In the above-mentioned control system for carrying out the above-mentioned one cycle motion, limit switches or other conventional electric detectors can be utilized instead of utilizing the above-mentioned timers.

Figure 15A:
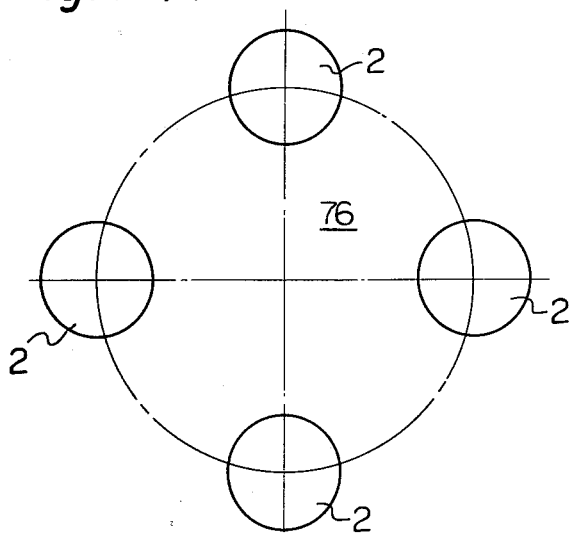
FIGS. 15A and 15B are plan views of cans-arrangements on the turn table of the cans-arrangement station shown in FIG. 14A.
Figure 15B:
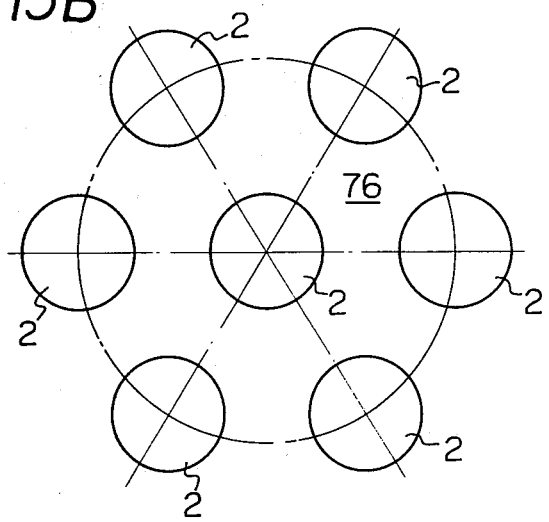

Various arrangements can be adopted for full packaged cans 2 in the dyeing bath according to the capacity and structure of the dyeing baths. Several examples are shown in FIGS. 15A and 15B. For instance, when four cans are arranged as shown in FIG. 15A, the turn table 76 is rotated by 90° for one can 2 while maintaining a constant stroke in the pneumatic cylinder 75 (FIG. 14A), and; if four cans 2 are thus pushed onto the turn table 76, the arrangement shown in FIG. 15A can be attained. In case of the seven can arrangement shown in FIG. 15B, the first can 2 is located at the center of the turn table 76 by operating the pneumatic cylinder 75 (FIG. 14A) at a long stroke, and then, the stroke of the pneumatic cylinder 75 is shortened and the subsequent six cans 2 are arranged on the turn table 76 by rotating the turn table 76 by 60° for every can 2. Thus, the arrangement shown in FIG. 15B can be attained.

Step (d)

Referring to FIG. 1 again, the full packaged cans thus arranged on the turn table 76 are carried by the overhead crane device Z, including chucks set in a positional relationship conforming completely to the above-mentioned arrangement of the full packaged cans 2, in such a way that the heads of the spindles 3 (FIG. 3A) of the cans 2 are gripped and held by the chucks, and the cans 2 are displaced into the dyeing bath F.

Figure 19:
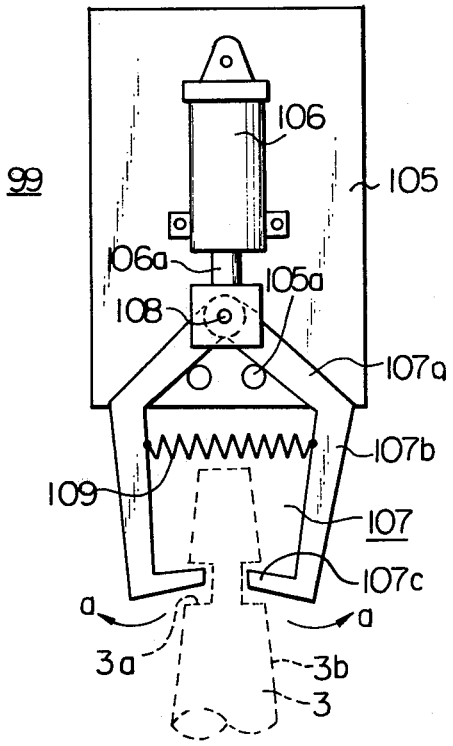
FIG. 19 is a side view of a chuck for holding a main can, utilized for the dismounting station shown in FIG. 17A.

Since the construction and function of the above-mentioned chucks are quite similar to the chuck which is illustrated in FIG. 19 and which will be described later, the detailed explanation thereof is omitted now.

Figure 16:
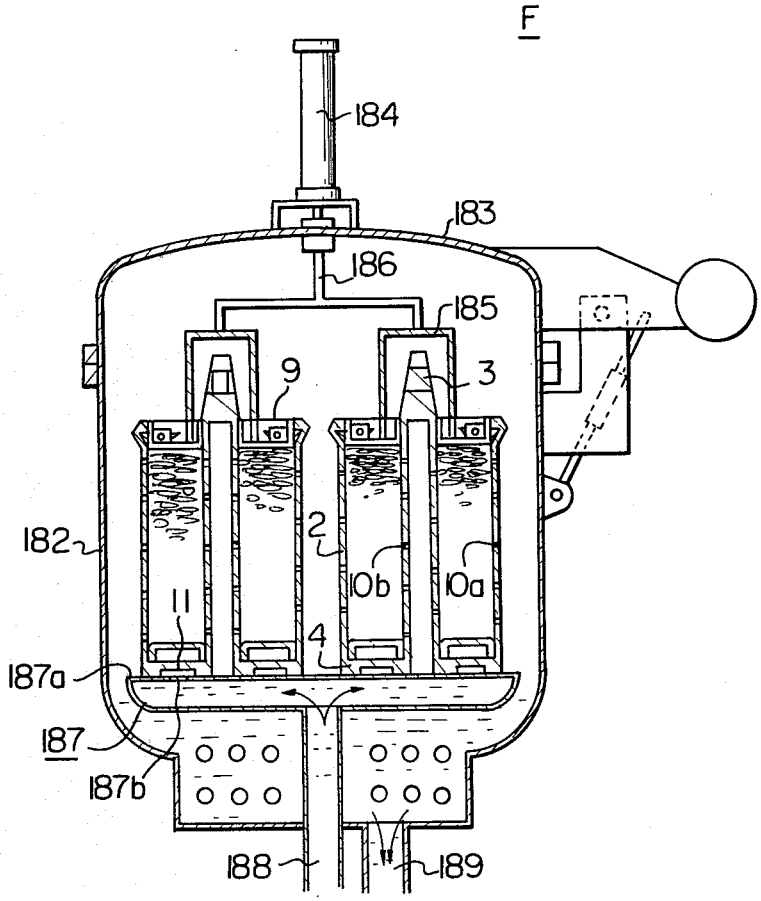
FIG. 16 is a schematic side view, partly in section, of the dyeing bath utilized for the sliver dyeing method according to the present invention.

As shown in FIG. 16, the dyeing bath F utilized for carrying out the present invention comprises a bath body 182 and a cover 183 displaceably supported. A hollow disc 187 for supplying a dyeing liquid is disposed in the bath body 182 at the inside bottom portion thereof and the hollow disc 187 is connected to a liquid supply conduit 188 at a bottom portion thereof while a plurality of apertures 187*b* are formed at an upper horizontal plate 187*a* thereof. These apertures 187*b* are arranged in such a condition that when a predetermined number of full packaged cans 2 are transported from the turn table 76 (FIG. 1) by the overhead crane Z and are mounted on the horizontal plate 187*a*, the bottom apertures 11 of each can 2 communicate with these apertures 187*b*. The bath body 182 is provided with a discharge conduit 189 connected to the bottom portion thereof. The cover 183 is provided with a cap 185 for sealing a gap between the upper lid 9 and the hollow spindle 3 of each can 2, so that the dyeing solution can be prevented from leaking through the gap. The cap 185 is suspended from the cover 183 by way of a holding member 186, which member is connected to a pneumatic cylinder 184 fixed on the cover 183, in such a condition that, when the cover 183 is engaged with the bath body 182 and the pneumatic cylinder 184 is operated each cap 185 pushes the upper lid 9 downward so as to insert the upper lid 9 onto the respective spindle 3 without gap. As mentioned above, when the full packaged cans 2 are mounted in the dyeing bath, the apertures 11 formed on the bottom plates 4 of the main can 2 are completely in agreement with dyeing solution apertures 187*b* formed on the hollow disc 187.

The dyeing liquid is compressed by a pump (not shown) and is flowed toward the hollow disc 187 from the supply conduit 188. Then, the dyeing solution passes through the interior of the sliver via small apertures 10*b* formed on the hollow spindle 3 of the main can 2 and is introduced into the inside space of the bath 182 through the apertures 10*a* of the can 2. The dyeing liquid is then discharged from the bath 182 by way of the discharge conduit 189. Thus, the dyeing solution is recycled along a flow passage indicated by arrows in FIG. 16, whereby the slivers in the main can 2 are dyed. Since this cap 185 is attached to the cover 183 of the dyeing tank 182, when the tank 182 is covered with this cover 183 and the pneumatic cylinder 184 is operated, the cap 185 is automatically placed on the corresponding spindle 3.

Step (e)

(e-1) Dismounting Station

Figure 17A:
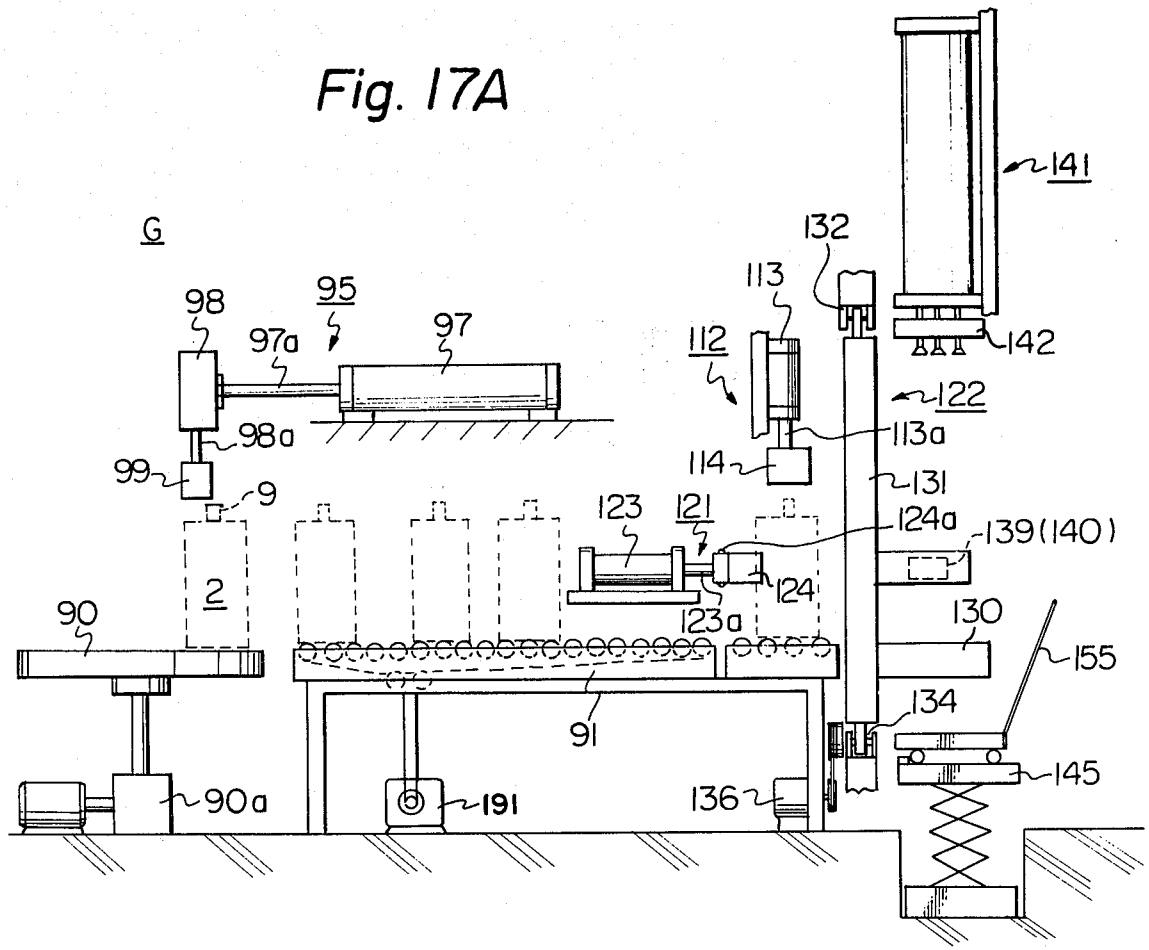
FIG. 17A is a schematic side view of the dismounting station according to the present invention.
Figure 18:
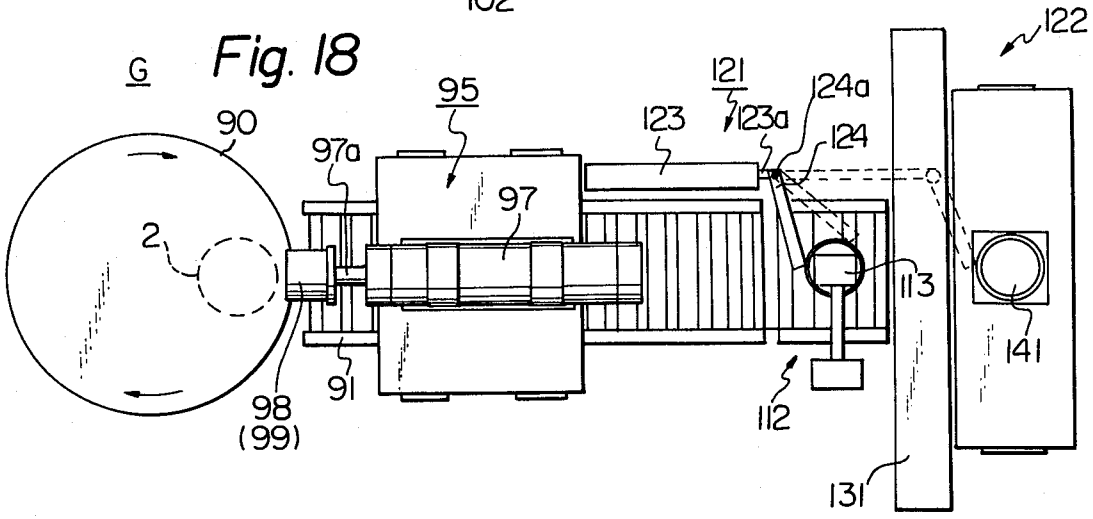
FIG. 18 is a plan view of the dismounting station shown in FIG. 17A.

As shown in FIGS. 17A and 18, the dismounting station G comprises a turn table 90 and subsequent storage conveyer 91, upper lid-separating device 112, turnover device 122, and sliver take-out device 141. It further includes a device 95 for transfer cans 2 from the turn table 90 to the storage conveyer 91 and a pusher 121 for delivering cans 2 to the upper lid-separating device 112 from the storage conveyer 91.

After completion of the dyeing operation, the full can 2 is disassembled and the sliver is separated and transferred to the spinning process. More specifically, the full cans 2 are taken out of the dyeing bath F (FIG. 1) by the overhead crane device Z (FIG. 1) while maintaining the above-mentioned arrangement and, then, the full cans 2 are located on the turn table 90 as illustrated in FIGS. 17A and 18. By the transfer device 95, which is provided with a lift, the can 2 are set in a line on the storage conveyer 91 according to procedures which are the reverse of the arrangement procedures prior to the dyeing operation, and they are stored on the storage conveyer 91 in this state.

The respective devices constituting the dismounting station will now be described.

(e-2) Transfer Device

In FIGS. 17A and 18, the transfer device 95 comprises an pneumatic cylinder 97, another pneumatic cylinder 98 disposed vertically, which is attached to the free end of the plunger 97*a* of the pneumatic cylinder 97 disposed horizontally, and a chuck 99 attached to the lower end of a plunger 98*a* of the pneumatic cylinder 98 to hold the spindle 3 (FIG. 3A) of the can 2. At the terminal point of the stroke, the plunger 97*a* of the pneumatic cylinder 97 is located just above the can 2 on the turn table 90. When the plunger 98*a* of the pneumatic cylinder 98 is brought down, the chuck 99 holds the top end of the spindle 3 of the can 2, and when the plunger 98*a* is lifted again, the chuck 99 brings up the can 2. When the plunger 97*a* of the pneumatic cylinder 97 is then moved back, the can 2 is brought onto the storage conveyer 91. In this state, the plunger 98*a* of the pneumatic cylinder 98 is brought down again, the can 2 is loaded on the rear end of the storage conveyer 91, and the gripping of the chuck 99 on the can 2 is released. The structure of this chuck 99 is illustrated in FIG. 19 and will be described later.

In the above-mentioned embodiment, the relative position of the pneumatic cylinder 97 and the turn table 90, and the stroke of the plungers 97*a* and 98*a*, are fixed to carry out the above-mentioned operation. The motion of the turn table 90 is carried out by utilizing a driving mechanism 90*a* (FIG. 17A) having a similar function to that of the driving mechanism 83 shown in FIG. 13.

Figure 17B:
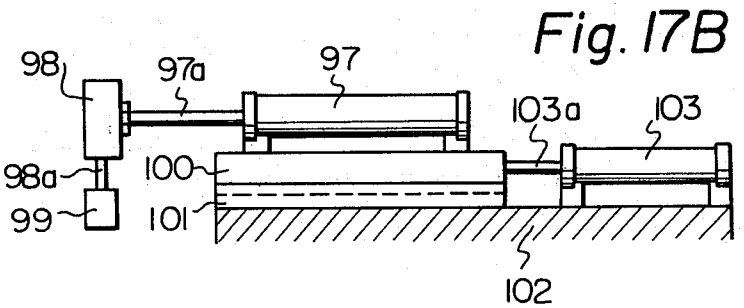
FIG. 17B is a schematic side view of a part of the modified embodiment of the dismounting station according to the present invention.

If the cans-arrangement shown in FIG. 15B is applied, a modified embodiment of the pneumatic cylinder system for displacing the pneumatic cylinder 98, shown in FIG. 17B, is utilized. That is, in this modified system, the pneumatic cylinder 97 is mounted on a slider 100, which is slidably mounted on a guide 101 by the dovetail engagement. An auxiliary pneumatic cylinder 103 is mounted on a frame 102, whereon the guide 101 is formed, and a plunger 103*a* thereof is connected to the slider 100. The stroke of the plunger 103*a* is fixed in such a condition that, when the pneumatic cylinders 97 and 103 are actuated simultaneously, the pneumatic cylinder 98 can be positioned at a position right above the turning center of the turn table 90 (FIG. 17A).

The sequential operation of the above-mentioned pneumatic cylinders 97, 98 and 103 in the embodiments shown in FIGS. 17A and 17B are controlled by a control device comprising a timer and position detectors, having similar functions to those described in the explanation regarding the cans-arrangement device shown in FIG. 14A. Therefore, the detailed explanation thereof is omitted.

The mechanism and function of the chuck 99 is hereinafter explained in detail. Referring to FIG. 19, the chuck 99 comprises a frame body 105 and pneumatic cylinder 106 rigidly mounted on the frame body 105, and a pair of guide pins 105*a* horizontally projected outward from the frame body 105. The pneumatic cylinder 106 is provided with a plunger 106*a* which is capable of projecting downward therefrom when the cylinder 106 is actuated. A pair of hooks 107 are turnably mounted on a pin shaft 108 secured to a bottom end of the plunger 106*a*. Each hook 107 is provided with a base portion 107*a* inclined outward from the mounting position thereof on the pin shaft 108, a hook portion 107*c* turned inside and an intermediate portion 107*b* which connects the base portion 107*a* to the hook portion 107*b*. The base portion 107*a* of each hook 107 rides on the corresponding guide pin 105*a*. A tension spring 109 is mounted between the intermediate portions 107*b*. Consequently, each base portion 107*a* of the hooks 107 is always urged to the corresponding guide pin 105*a*. When the pneumatic cylinder 106 is actuated, the plunger 106*a* is projected downward so that the hooks 107 are forced to turn outward, as indicated by the respective arrows a. When the actuation of the pneumatic cylinder 106 is released, the plunger 106*a* is pulled into the pneumatic cylinder 106, so that the hooks 107 are turned in respective directions opposite to the above-mentioned turning motion thereof represented by the arrows a. That is, the free ends of the hook portions 107*c* are forced to approach each other by the contracting force of the tension spring 109. The relative disposition of the guide pins 105*a* is designed in such a condition that, when the pneumatic cylinder 106 is actuated, the distance between the free ends of the hook portions 107*c* becomes large enough to allow the free pass of the top portion of the hollow spindle 3 of each main can 2 (FIG. 3A), while when the actuation of the pneumatic cylinder 106 is released, the above-mentioned distance is almost identical to the diameter of a grooved portion 3*a* formed at the top portion 3*b* of the hollow spindle 3. In the above-mentioned embodiment of the chuck 99, when the pneumatic cylinder 98 (FIG. 17A) is actuated, the pneumatic cylinder 106 is simultaneously actuated by a signal from the control device for controlling the motions of the pneumatic cylinders 97 and 98 (FIG. 17A). When the plunger 98*a* (FIG. 17A) is displaced to the projection terminal thereof, such condition is detected by a detector (not shown), such as a limit switch or other detector such as a combination of a light ejector and a photocell, and the actuation of the pneumatic cylinder 106 is released by a signal issued from such detector. As mentioned above, if a spindle 3 of a can 2 is located at a predetermined position where the hooks 107 are capable of sandwiching a top end portion of the hollow spindle 3 of a can 2, the hollow spindle 3 can be easily and stably caught by the hook portions 107*c* of the hook 107 by releasing the actuation of the pneumatic cylinder 106.

(e-3) Lid-separating Device

Every time the storage conveyer 91 receives one full packaged can 2, the storage conveyer 91 advances the cans 2 at a predetermined pitch, by means of utilizing a conventional step motor 191 as illustrated in FIG. 17A, and thus, the full packaged cans 2 are positioned thereon in one line. The upper lid-separating device 112 is disposed at a position right above the front end part of the storage conveyer 91 to separate the upper lid 9 mounted on the top face of the can 2, for protecting the sliver, and the preparation for the subsequent sliver take-out operation is carried out. In FIG. 17A, this lid-separating device 112 comprises a pneumatic cylinder 113 vertically disposed at a position right above the front end part of the storage conveyer 91 and a chuck 114 attached to the lower end of a plunger 113*a* of the pneumatic cylinder 113. The structure of this chuck 114 is shown in FIG. 20A.

Figure 20A:
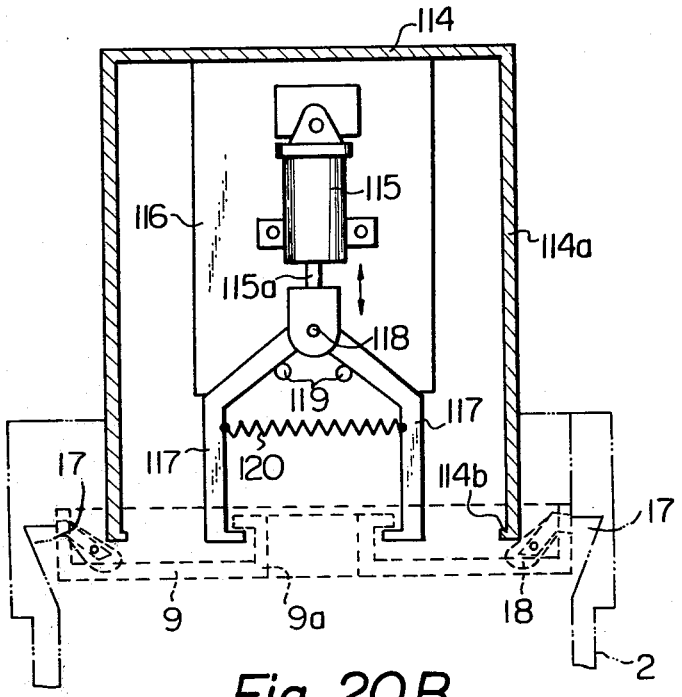
FIG. 20A is a side view, partly in section of the lid separating device utilized for the dismounting station shown in FIG. 17A.

Referring to FIG. 20A, the chuck 114 comprises a cylindrical body 114*a* opened at the bottom portion thereof and a pneumatic cylinder 115 secured to a supporting bracket 116 secured to the cylindrical body 114*a* at a position in the inside thereof. The pneumatic cylinder 115 is provided with a plunger 115*a* and a pair of hooks 117 are turnably mounted on a pin shaft 118 horizontally secured to a bottom free end of the plunger 115*a*. A pair of guide pins 119 are horizontally projected from the supporting bracket 116 and the hooks 117 ride on the respective guide pins 119. Each hook 117 is provided with the guide of similar shape and function to the hook 107 of the chuck 99 shown in FIG. 19. A tension spring 120 is connected at both ends thereof to the respective hooks 117, so as to always urge the hooks 117 toward each other. Since the motion of each hook 117 relative to the motion of the pneumatic cylinder 115 is quite similar to the chuck 99 shown in FIG. 19, the detailed explanation concerning the motion of each hook 117 is omitted. The dimensions of these members of the chuck 114 are determined so that, when the chuck 114 is brought down, the lower end edge of the cylindrical body 114*a* falls into contact with the top face of the rear end of the movable claw 18 of the upper lid 9, and when a pressing force is further applied to the chuck 114, the front end of the movable claw 18 is sprung up and is separated from the groove 17 of the main can 2. In this state, the pneumatic cylinder 115 is operated, and the top end of the hook 117 is caused to hold the central bulged portion 9*a* of the upper lid 9. When the pneumatic cylinder 113 (FIG. 17A) starts the returning motion, the chuck 114 is caused to rise up while holding the upper lid 9. Thus, separation of the upper lid 9 from the main can 2 is accomplished. The so separated lids 9 are collected in a manner as described hereinafter and delivered to upper lid supply means attached to the sliver filling device A (FIG. 1).

Figure 20B:
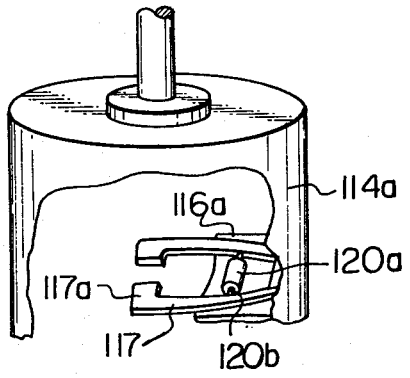
FIG. 20B is a perspective view, partly in section, of a modified embodiment of the lid separating device utilized for the dismounting station shown in FIG. 17A.

A modified embodiment of the chuck 114 is shown in FIG. 20B, wherein a supporting bracket 116*a* is projected inward from an inside wall of the cylindrical body 114*a* and a pair of hooks 117 are turnably mounted on a pin shaft (not shown) secured to the supporting bracket 116*a*. A solenoid 120*a* is mounted to one of the hooks 117 and a plunger 120*b* of the solenoid 120*a* is connected to the other hook 117. The distance between the hook portions 117*a* is changed by actuating the solenoid 120*a* or releasing the actuation of the solenoid 120*a* so as to grip the bulged portion 9*a* of the upper lid (FIG. 20A), or so as to release the above-mentioned grip.

(e-4) Pusher

In FIGS. 17A and 18, after the can 2 is separated from the upper lid 9, the can 2 is transferred onto a pedestal 130 of the turnover device 122, described hereinafter, by the action of the pusher 121. The pusher 121 comprises a pneumatic cylinder 123 disposed at the side of the storage conveyer 91 along the conveyer 91 and a bar 124 horizontally and rotatably pivoted on the top end of the plunger 123*a* of the pneumatic cylinder 123 via a pin 124*a* and projected obliquely forward. The top end of the bar 124 is located at a position where it falls into contact with the body portion of the leading can on the storage conveyer 91 by means of a stop (not shown), and is urged backwardly by a spring (not shown). Consequently, when a force is applied from the rear, the bar 124 is turned forwardly against the urging force of the spring (not shown) due to the applied force, but when a force is applied from the front, the bar 24 is prevented from being turned beyond a certain angle by the stop (not shown) and resists the applied force. Accordingly, the can 2 is advanced to a position near the plunger 123*a* of the pusher 121 by the intermittent movement of the storage conveyer 91, and; when the can 2 is further advanced to the front part of the storage conveyer 91, the front face of the can 2 pushes the bar 124 from the back thereof while letting the bar 124 move forwardly. Then, the bar 124 is separated from the can 2, and is returned to its original posture by the force of the spring (not shown) and located in the rear of the can 2. After the lid 9 of the can 2 at the leading position has thus been separated, when the pneumatic cylinder 123 is operated, the bar 124 pushes forwardly the can 2 from the back so as to locate the can 2 on the plinth of the subsequent turnover device 122. The time sequence of the above-mentioned motions of the elements is controlled by a control device (not shown) which is provided with limit switches and timers, and which is operated on a quite similar principle as the control device of the cans-arrangement device shown in FIG. 13.

(e-5) Turnover Device

Figure 21:
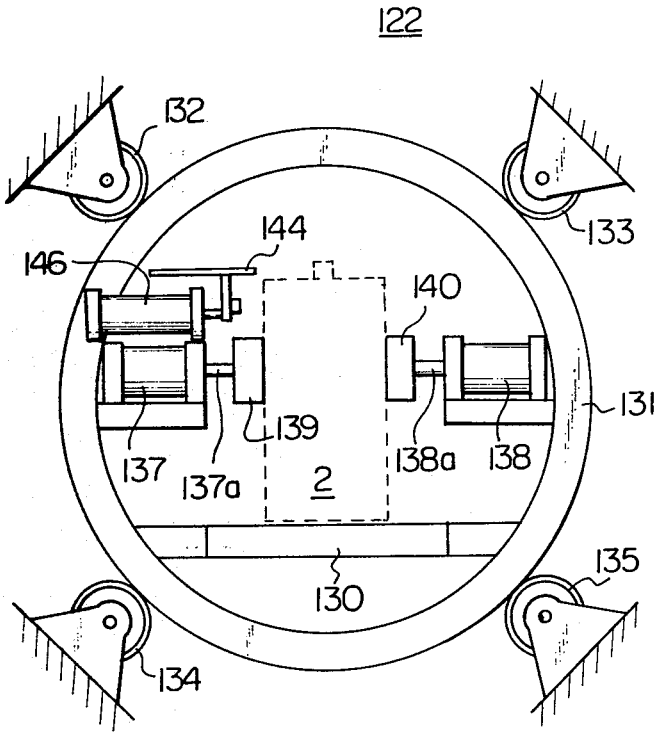
FIG. 21 is a front view of the turnover device utilized for the dismounting station shown in FIG. 17A.

The turnover device 122 is disposed to turn over the can 2 and, then, the sliver is taken out from the can 2. As shown in FIG. 17A, the pedestal 130 of the turnover device 122 is fixed in the outwardly projecting state on a lower portion of a circular frame 131. The circumference of the circular frame 131 is, as illustrated in FIG. 21, vertically supported by supporting rollers 132, 133, 134 and 135 and the circular frame 131 is capable of being rotated along these supporting rollers by a motor 136 (FIG. 17A). In FIG. 21, clamps 139 and 140 are attached to the top ends of plungers 137*a*, 138*a* of respective pneumatic cylinders 137, 138 which are horizontally disposed. The clamps 139 and 140 are so positioned at the inside of the interior of the circular frame 131 that they confront each other, and are capable of gripping and holding the body portion of the can 2 therebetween. The clamps 139 and 140 are supported in such a manner that they are projected and located just above the pedestal 130. Referring to FIG. 17A again, the sliver take-out device 141 is equipped with a vertically movable push-out head 142 and is disposed just above these clamps 139 and 140. The shape and layout of the push-out head 142 are arranged so that the push-out head 142 can be inserted into three apertures 11 (FIG. 3A) formed on the bottom plate 4 of the main can 2. The push-out head 142 is also capable of being connected to a vacuum means (not shown) in accordance with the changeover operation so as to exert an attracting action of the movable bottom plate 8.

Referring to FIG. 21 again, a temporary covering slide 144 is mounted in a side-by-side relation to the clamp 139, so that it can horizontally move to and away from the top face of the can 2 by means of a pneumatic cylinder 146. A vertically movable lifter 145 (FIG. 17A) is disposed just below the pedestal 130 and is capable of mounting a transfer truck 155 thereon.

The can 2, which is loaded at a predetermined position of the pedestal 130 in the above-mentioned foregoing manner, is gripped and held by the clamps 139 and 140. Then, the top face of the can 2 is covered with the temporary covering slide 144 (FIG. 21).

The circular frame 131 is then rotated by 180° and, therefore, the can, together with the pedestal 130, is turned over. In this state, the push-out head 142 (FIG. 22) is brought down through a piercing aperture 154 formed on the pedestal 130, and the sliver is projected downwardly from the can 2 onto the truck 155 (see FIG. 17A) mounted on the lifter 145.

(e-6) Take-out Device

Figure 22:
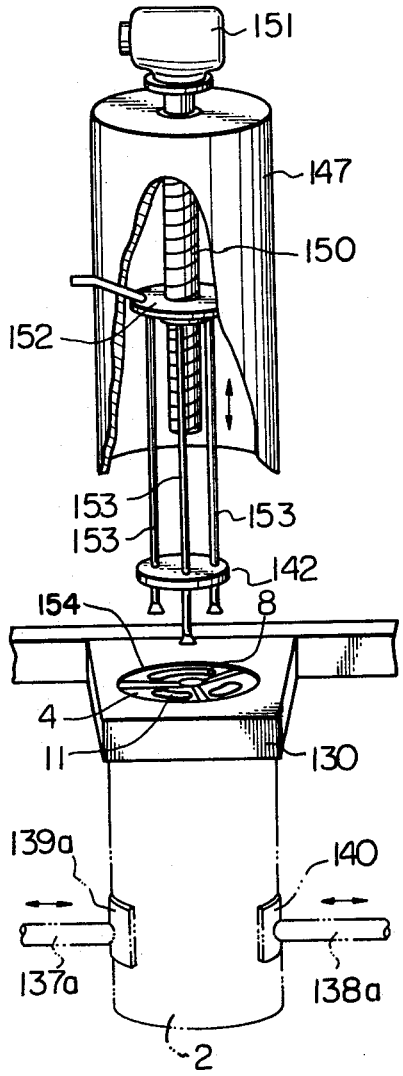
FIG. 22 is a perspective view, partly in section, of the push-out head, utilized for the dismounting station shown in FIG. 17A.

The take-out device 141 has a structure as shown in FIG. 22. More specifically, a guide rod 150 having a spiral male groove formed thereon is fixed to an output shaft of a geared motor 151 mounted in the upper portion of a frame 147. A movable plate 152, which is vertically movable but free from rotation, has a female screw groove formed therein to be engaged with the male groove of the guide rod 150, and is screwed to the guide rod 150. Three parallel pipes 153 extending downwardly are attached to the lower face of the movable plate 152. These pipes 153 are communicated with a suction source (not shown), so that a sucking force is appropriately applied thereto, and then, an attracting force is created on the top end of each pipe 153.

When the turnover device 122 is rotated by 180°, as described above with reference to FIG. 21, the can 2 is turned over together with the pedestal 130, and then, the temporary covering slide 144 is moved backward and the geared motor 151 is turned on. By the operation of the geared motor 151, the guide rod 150 is rotated to move the movable plate 152 downwardly. Accordingly, the pipes 153 are brought down through the piercing hole 154 formed on the pedestal 130 and the sliver with the movable bottom plate 8 of the can 2 is pushed down. A truck 155 (FIG. 17A) stands by on the lifter 145 and receives the sliver from the can 2. With the discharge of the sliver, the lifter 145 is brought down so that the discharge operation is smoothly effected without causing any damage to the sliver. Suction is applied through the pipes 153 (FIG. 22) during the above push-out operation so as to suck and hold the movable bottom plate 8. Accordingly, only the sliver is discharged on the truck 155 and the movable bottom plate 8 is left in the can 2. Thereafter, the temporary covering slide 144 (FIG. 21) is advanced again onto the can 2 and application of suction to the pipes 153 is stopped. Simultaneously, the geared motor 151 is turned in the reverse direction so as to raise the push-out head 142, and the movable bottom plate 8 is held by the temporary covering slide 144.

The turnover device is then rotated again by 180° to restore the can to its normal vertical posture and, after that, the temporary covering slide 144 is moved backward by means of the pneumatic cylinder 146 (FIG. 21).

Step (f)

The operation of assembling the can which has been disassembled in the above-mentioned manner for discharge of the sliver will now be described.

The main can 2, from which the sliver has been discharged, is delivered to the above-mentioned pressing device B (FIG. 1) by appropriate delivery means and is set at a predetermined position just below the press head 61 (FIG. 11). The auxiliary can 5 and auxiliary spindle 7 are held and made to stand-by on the press head 61 in the same state as the state when they were dismounted from the main can 2. When only the press head 61 is brought down, the auxiliary can 5 and auxiliary spindle 7 are coupled with the main can 2. Therefore, the operation of the holding members 65 and 68 attached to the press head 61 is released, the press head 61 is raised again and an assembled can 1 is obtained. The assembled can 1 is then recycled to the sliver filling device A (FIG. 1) by means of the above-mentioned delivery truck Y.

What is claimed is:

1. A method for dyeing a bundle of fibers comprising the steps of:

(a) filling a bundle of fibers into a dyeing can composed of a main can and an auxiliary can separably joined on said main can while forming coils of said bundle of fibers;

(b) creating a full packaged dyeing can provided with a main can containing a compressed mass of said bundle of fibers by pushing a total mass of said bundle of fibers accumulated in both said auxiliary can and said main can from above until the total mass of said bundle of fibers initially accumulated in said auxiliary can is pressed into said main can and said auxiliary can is emptied, (c) separating said main can wherein a compressed mass of said bundle of fibers is contained from said auxiliary can;

(d) arranging a plurality of full packaged main cans in a predetermined positional relationship conforming to the layout of the main cans in a dyeing bath;

(e) mounting said full packaged main cans in said dyeing bath while maintaining said positional relationship and carrying out a dyeing operation, and;

(f) taking out said main cans from said dyeing bath after completion of said dyeing operation and taking out dyed bundles of fibers from said main cans by turning over said main cans respectively.

2. A method for dyeing a bundle of fibers according to claim 1, further comprising a step (g) of assembling an empty main can from said step (f) with an auxiliary can from said step (c) so that an empty dyeing can can be prepared.

3. A method for dyeing a bundle of fibers according to claim 2, wherein can bodies are automatically transported among said respective steps.

4. A method for dyeing a bundle of fibers according to claim 1, wherein can bodies are automatically transported among said respective steps.

* * * * *